US009682259B2

(12) United States Patent
Sampson

(10) Patent No.: US 9,682,259 B2
(45) Date of Patent: Jun. 20, 2017

(54) FIRE SUPPRESSION SYSTEMS AND METHODS OF SUPPRESSING A FIRE

(71) Applicant: ORBITAL ATK, INC., Dulles, VA (US)

(72) Inventor: William P. Sampson, North Ogden, UT (US)

(73) Assignee: Orbital ATK, Inc., Plymouth, MN (US)

( * ) Notice: Subject to any disclaimer, the term of this patent is extended or adjusted under 35 U.S.C. 154(b) by 135 days.

(21) Appl. No.: 14/629,065

(22) Filed: Feb. 23, 2015

(65) Prior Publication Data

US 2015/0174438 A1 Jun. 25, 2015

Related U.S. Application Data

(63) Continuation of application No. 13/267,427, filed on Oct. 6, 2011, now Pat. No. 8,967,284.

(51) Int. Cl.
*A62C 5/00* (2006.01)
*A62C 13/22* (2006.01)
(Continued)

(52) U.S. Cl.
CPC ..... *A62C 13/22* (2013.01); *A62C 5/006* (2013.01); *A62C 13/76* (2013.01); *A62C 35/023* (2013.01)

(58) Field of Classification Search
CPC ..... A62C 5/006; A62C 13/22; A62C 35/023
See application file for complete search history.

(56) References Cited

U.S. PATENT DOCUMENTS 1,839,658 A 1/1932 Dugas
2,744,816 A 5/1956 Hutchison
(Continued)

FOREIGN PATENT DOCUMENTS

CN 2661989 Y 12/2004
CN 1695750 A 11/2005
(Continued)

OTHER PUBLICATIONS

Kim, A. "Overview of Recent Progress in Fire Suppression Technology," National Research Council Canada—45690, 2nd NRIFD Symposium, Proceedings, Tokyo, Japan, (Jul. 2002), pp. 1-13 (15 pages).
(Continued)

*Primary Examiner* — Ryan Reis
(74) *Attorney, Agent, or Firm* — TraskBritt

(57) ABSTRACT

Fire suppression apparatuses include a housing with gas generant material disposed therein, an initiator for igniting the gas generant material, and a cooling system. The cooling system includes a first chamber with a coolant material disposed therein and a second chamber. The coolant material is caused to flow from the first chamber into the second chamber to cool gas formed by the ignition of the gas generant material upon exiting from the housing under pressure. The cooling system may further include a piston disposed within the first chamber and movable responsive to gas pressure. Methods for cooling a fire suppressant gas and methods for suppressing a fire include flowing a fire suppressant gas into first and second chambers of a cooling system, flowing a coolant material from the first chamber into the second chamber, and contacting the fire suppressant gas with the coolant material to cool the fire suppressant gas.

17 Claims, 9 Drawing Sheets

(51) Int. Cl.
*A62C 35/02* (2006.01)
*A62C 13/76* (2006.01)

(56) References Cited

U.S. PATENT DOCUMENTS 2,841,227 A 7/1958 Betzler
3,255,824 A 6/1966 Rodgers
3,524,506 A 8/1970 Weise
3,641,935 A 2/1972 Gawlick et al.
3,701,256 A 10/1972 Pelham et al.
3,741,585 A 6/1973 Hendrickson et al.
3,806,461 A 4/1974 Hendrickson et al.
3,836,076 A 9/1974 Conrad et al.
3,889,757 A 6/1975 Dunn
3,972,820 A 8/1976 Filter et al.
4,064,944 A 12/1977 McClure et al.
4,067,392 A 1/1978 Rich
4,113,019 A 9/1978 Sobolev et al.
4,224,994 A 9/1980 Tone et al.
4,448,577 A 5/1984 Paczkowski
4,505,336 A 3/1985 Thevis et al.
4,601,344 A 7/1986 Reed, Jr. et al.
4,616,694 A 10/1986 Hsieh
4,807,706 A 2/1989 Lambertsen et al.
4,817,828 A 4/1989 Goetz
4,890,860 A 1/1990 Schneiter
4,909,549 A 3/1990 Poole et al.
4,931,111 A 6/1990 Poole et al.
4,998,751 A 3/1991 Paxton et al.
5,035,757 A 7/1991 Poole
5,038,866 A 8/1991 Kern et al.
5,060,867 A 10/1991 Luxton et al.
5,109,772 A 5/1992 Cunningham et al.
5,172,445 A 12/1992 Chandler
5,197,758 A 3/1993 Lund et al.
5,423,384 A 6/1995 Galbraith et al.
5,425,886 A 6/1995 Smith
5,429,691 A 7/1995 Hinshaw et al.
5,439,537 A 8/1995 Hinshaw et al.
5,441,114 A 8/1995 Spector et al.
5,449,041 A 9/1995 Galbraith
5,465,795 A 11/1995 Galbraith et al.
5,495,893 A 3/1996 Roberts et al.
5,520,826 A 5/1996 Reed, Jr. et al.
5,531,941 A 7/1996 Poole
5,538,568 A 7/1996 Taylor et al.
5,542,704 A 8/1996 Hamilton et al.
5,544,687 A 8/1996 Barnes et al.
5,588,493 A 12/1996 Spector et al.
5,609,210 A 3/1997 Galbraith et al.
5,610,359 A 3/1997 Spector et al.
5,613,562 A 3/1997 Galbraith et al.
5,660,236 A * 8/1997 Sears ..... A62C 35/023 169/33
5,673,935 A 10/1997 Hinshaw et al.
5,712,445 A 1/1998 Kassuelke et al.
5,725,699 A 3/1998 Hinshaw et al.
5,735,118 A 4/1998 Hinshaw et al.
5,739,460 A 4/1998 Knowlton et al.
5,762,145 A 6/1998 Bennett
5,772,243 A 6/1998 Green et al.
5,783,773 A 7/1998 Poole
5,820,160 A 10/1998 Johnson et al.
5,845,716 A * 12/1998 Birk ..... A62C 35/023 169/43
5,845,933 A 12/1998 Walker et al.
5,848,652 A 12/1998 Bennett
5,861,106 A 1/1999 Olander
5,865,257 A 2/1999 Kozyrev et al.
5,876,062 A 3/1999 Hock
5,882,036 A 3/1999 Moore et al.
5,884,710 A 3/1999 Barnes et al.
5,918,679 A 7/1999 Cramer
5,957,210 A 9/1999 Cohrt et al.
5,985,060 A 11/1999 Cabrera et al.
5,992,528 A * 11/1999 Parkinson ..... A62C 13/22 169/26
5,992,530 A 11/1999 Sundholm
5,992,881 A 11/1999 Faigle
5,996,699 A 12/1999 Sundholm
6,012,533 A 1/2000 Cramer
6,016,874 A 1/2000 Bennett
6,019,177 A 2/2000 Olander
6,019,861 A 2/2000 Canterberry et al.
6,024,889 A 2/2000 Holland et al.
6,039,347 A 3/2000 Maynard
6,039,820 A 3/2000 Hinshaw et al.
6,045,637 A 4/2000 Grzyll
6,045,638 A 4/2000 Lundstrom
6,065,774 A 5/2000 Cabrera
6,076,468 A * 6/2000 DiGiacomo ..... C06D 5/06 102/530
6,077,372 A 6/2000 Mendenhall et al.
6,082,464 A 7/2000 Mitchell et al.
6,086,693 A 7/2000 Mendenhall et al.
6,089,326 A 7/2000 Drakin
6,093,269 A 7/2000 Lundstrom et al.
6,095,559 A 8/2000 Smith et al.
6,096,147 A 8/2000 Taylor et al.
6,116,348 A 9/2000 Drakin
6,123,359 A 9/2000 Cabrera et al.
6,132,480 A 10/2000 Barnes et al.
6,136,114 A 10/2000 Johnson et al.
6,143,104 A 11/2000 Blomquist
6,149,193 A 11/2000 Canterberry et al.
6,196,583 B1 3/2001 Ruckdeschel et al.
6,202,755 B1 3/2001 Hardge
6,217,788 B1 4/2001 Wucherer et al.
6,224,099 B1 5/2001 Nielson et al.
6,250,072 B1 6/2001 Jacobson et al.
6,257,341 B1 7/2001 Bennett
6,287,400 B1 9/2001 Burns et al.
6,314,754 B1 11/2001 Kotliar
6,328,906 B1 12/2001 Lundstrom et al.
6,334,315 B1 1/2002 Kotliar
6,357,355 B1 3/2002 Fogle, Jr.
6,371,213 B1 4/2002 Smith et al.
6,371,384 B1 4/2002 Garcia
6,401,487 B1 6/2002 Kotliar
6,416,599 B1 7/2002 Yoshikawa et al.
6,418,752 B2 7/2002 Kotliar
6,435,552 B1 8/2002 Lundstrom et al.
6,474,684 B1 11/2002 Ludwig et al.
6,481,746 B1 11/2002 Hinshaw et al.
6,502,421 B2 1/2003 Kotliar
6,513,602 B1 2/2003 Lewis et al.
6,557,374 B2 5/2003 Kotliar
6,560,991 B1 5/2003 Kotliar
6,599,380 B2 7/2003 Zeuner et al.
6,601,653 B2 8/2003 Grabow et al.
6,605,233 B2 8/2003 Knowlton et al.
6,612,243 B1 9/2003 Italiane et al.
6,634,433 B2 10/2003 Kim et al.
6,739,399 B2 5/2004 Wagner et al.
6,851,483 B2 2/2005 Olander et al.
6,935,433 B2 8/2005 Gupta
6,942,249 B2 9/2005 Iwai et al.
6,981,555 B2 1/2006 Smith et al.
6,990,905 B1 1/2006 Manole et al.
7,028,782 B2 4/2006 Richardson
7,059,633 B2 6/2006 Wang et al.
7,073,820 B2 7/2006 McCormick
7,156,184 B2 1/2007 Wagner
7,337,856 B2 * 3/2008 Lund ..... A62C 99/0018 169/42
7,451,829 B2 11/2008 Thompson
7,455,119 B2 11/2008 Thompson
7,455,120 B2 11/2008 Richardson et al.
7,597,153 B2 10/2009 Thompson
7,770,924 B2 * 8/2010 Cox ..... B60R 21/264 102/530
7,845,423 B2 12/2010 Lund et al.
7,887,091 B1 2/2011 Cox et al.
8,047,569 B2 11/2011 Cox et al.

(56) References Cited

U.S. PATENT DOCUMENTS

| | | | | |
|---|---|---|---|---|
| 8,162,350 | B1 | 4/2012 | Parkinson et al. | |
| 8,408,322 | B2 | 4/2013 | Blau et al. | |
| 8,808,476 | B2 | 8/2014 | Mendenhall et al. | |
| 8,939,225 | B2 | 1/2015 | Cox et al. | |
| 2002/0007886 | A1 | 1/2002 | Neidert et al. | |
| 2002/0020536 | A1 | 2/2002 | Bennett | |
| 2002/0137875 | A1 | 9/2002 | Reed et al. | |
| 2002/0195181 | A1 | 12/2002 | Lundstrom et al. | |
| 2003/0222445 | A1 | 12/2003 | Patterson | |
| 2004/0089383 | A1 | 5/2004 | Mendenhall et al. | |
| 2004/0145166 | A1 | 7/2004 | Smith | |
| 2004/0173922 | A1 | 9/2004 | Barnes et al. | |
| 2004/0216903 | A1* | 11/2004 | Wierenga | A62C 35/023 169/85 |
| 2005/0081419 | A1 | 4/2005 | Fleischhauer et al. | |
| 2005/0115721 | A1 | 6/2005 | Blau et al. | |
| 2005/0139365 | A1 | 6/2005 | Richardson | |
| 2005/0189123 | A1 | 9/2005 | Richardson et al. | |
| 2005/0235863 | A1 | 10/2005 | Stevens | |
| 2005/0257866 | A1 | 11/2005 | Williams et al. | |
| 2006/0278409 | A1 | 12/2006 | Blau et al. | |
| 2008/0128145 | A1 | 6/2008 | Butz et al. | |
| 2010/0013201 | A1 | 1/2010 | Cox et al. | |
| 2010/0116384 | A1 | 5/2010 | Mendenhall et al. | |
| 2010/0170684 | A1 | 7/2010 | Richardson et al. | |
| 2010/0194085 | A1 | 8/2010 | Mayville et al. | |
| 2010/0230942 | A1 | 9/2010 | Rose | |
| 2010/0307775 | A1 | 12/2010 | Robbins et al. | |
| 2011/0101662 | A1 | 5/2011 | Rose et al. | |
| 2011/0226493 | A1 | 9/2011 | Blau et al. | |
| 2012/0085556 | A1 | 4/2012 | Cox et al. | |

FOREIGN PATENT DOCUMENTS

| | | | |
|---|---|---|---|
| CN | 101700427 | A | 5/2010 |
| CN | 101915311 | A | 12/2010 |
| CN | 201871153 | U | 6/2011 |
| CN | 103153401 | A | 6/2013 |
| DE | 19546528 | A | 6/1997 |
| DE | 19602695 | | 7/1997 |
| DE | 19717044 | | 10/1997 |
| EP | 00009346 | | 8/1979 |
| EP | 0784998 | A2 | 7/1997 |
| EP | 0792777 | A1 | 9/1997 |
| EP | 0804945 | A2 | 11/1997 |
| EP | 0956883 | A1 | 11/1999 |
| EP | 1767248 | | 3/2007 |
| GB | 1219363 | A | 1/1971 |
| JP | 5248640 | | 11/1977 |
| JP | 07237520 | A | 9/1995 |
| JP | 3031800 | U | 12/1996 |
| JP | 09500296 | | 1/1997 |
| JP | 11197265 | A | 7/1999 |
| JP | 2001276273 | | 10/2001 |
| JP | 2001518046 | | 10/2001 |
| JP | 2001346898 | | 12/2001 |
| JP | 2002160992 | | 6/2002 |
| JP | 2002291939 | | 10/2002 |
| JP | 2004321272 | | 11/2004 |
| JP | 2007252731 | | 10/2007 |
| JP | 2007528322 | T | 10/2007 |
| JP | 2009072594 | | 4/2009 |
| JP | 2010216118 | A | 9/2010 |
| JP | 2011116229 | A | 6/2011 |
| WO | 9315793 | | 8/1993 |
| WO | 9500205 | A1 | 1/1995 |
| WO | 9846529 | A1 | 10/1998 |
| WO | 9901180 | | 1/1999 |
| WO | 0006424 | A1 | 2/2000 |
| WO | 0015305 | A1 | 3/2000 |
| WO | 03024534 | A1 | 3/2003 |
| WO | 2004028642 | | 4/2004 |
| WO | 2004091729 | | 10/2004 |
| WO | 2005039893 | A2 | 5/2005 |
| WO | 2008034805 | A1 | 3/2008 |
| WO | 2008140441 | | 11/2008 |
| WO | 2009050443 | A2 | 4/2009 |

OTHER PUBLICATIONS

Kim, A. "Advances in Fire Suppression Systems," National Research Council Canada, Construction Technology Update No. 75, (Mar. 2011), pp. 1-6.

Owens, J. "Physical and Environmental Properties of a Next Generation Extinguishing Agent," HOTWC 12th Proceedings (May 2002), 11 pages.

Annex to Form PCT/ISA/206, Communication Relating to the Results of the Partial International Search, mailed Jun. 24, 2005.

Bennett, Joseph Michael, U.S. Appl. No. 60/414,157, filed Sep. 28, 2002, entitled "In-Room Gas Generator Fire Protection System."

Berezovsky, "Pyrogen, A Revolution in Fire Suppression Technology?", Fire Safety Engineering, vol. 5, No. 5, Oct. 1998, pp. 31-33.

Communication pursuant to Article 94(3) EPC for European Patent Application No. 04812700.5, dated Apr. 21, 2015, 4 pages.

Concurrently filed co-pending patent Application, David W. Parkinson et al., titled "Gas Generator."

Co-pending U.S. Appl. No. 12/723,275, Additives for Liquid Cooled Inflators" filed Mar. 12, 2010.

Co-Pending U.S. Appl. No. 12/723,331, "Multi-Stage Inflator," filed Mar. 12, 2010.

Ebeling, Hans, et al., "Development of Gas Generators for Fire Extinguishing," Propellants, Explosives, Pyrotechnics, vol. 22, pp. 170-175, 1997.

Engelen, K., et al., "Pyrotechnic Propellant for Nitrogen Gas Generator," Bull. Soc. Chim Belg., vol. 106, No. 6, pp. 349-354, 1997.

Environmental Protection Agency (EPA) Significant New Alternatives Policy (SNAP). Federal Register, Rules and Regulations vol. 74, No. 1, (Jan. 2, 2009), pp. 21-29.

European Search Report for European Application No. EP1 0163294, dated Mar. 11, 2014, 2 pages.

Fallis, Stephen, et al., "Advanced Propellant/Additive Development for Fire Suppressing Gas Generators: Development + Test," Proceedings of HOTWC-2002 12th Halon Options Technical Working Conference, Albuquerque, NM, Apr. 20-May 2, 2002, National Institute of Standards and Technology Special Publication 984.

Fletcher M., Fighting Fire with Fire" Eureka (Inc. Engineering Materials and Design), Findlay Publications, Horton Kirby, Kent, GB, vol. 20, No. 1, Jan. 2000, p. 17, XP000877927, ISSN: 0261-2097.

Holland, G. et al., Sustainable Fire Protection for Military Vehicle and aircraft Applications" Suppression and Detection Research and Applications a Technical Working Conference, Orlando, Florida, Mar. 11-13, 2008 (12 Pages).

International Preliminary Examination Report for International Application No. PCT/CA03/01525 dated Jan. 17, 2005, 10 pages.

International Preliminary Examination Report on Patentability for International Application No. PCT/US2004/040248 dated Dec. 20, 2006, 11 pages.

International Search Report for International Application No. PCT/US2004/040248 mailed Nov. 23, 2006, 6 pages.

International Search Report for International Application No. PCT/US2004/040258 mailed Mar. 30, 2005, 3 pages.

International Search Report for International Application No. PCT/US2011/055091, issued Jul. 9, 2012, 4 pages.

Mitchell, Robert M., Olin Aerospace Company, Report on Advanced Fire Suppression Technology (AFST) Research and Development Program, 52 pages, Report Date Sep. 1994.

Office Action and Search Report for Chinese Patent Application No. 201180073596.2, dated Jul. 10, 2015, 24 pages.

Office Action and Search Report for Chinese Patent Application No. 201180073595.8, dated Jul. 20, 2015, 15 pages.

Notification of the First Office Action, State Intellectual Property Office of the People's Republic of China, Application No. CN 201180048185.8, Sep. 3, 2014, eight (8) pages (from 12296).

(56) References Cited

OTHER PUBLICATIONS

Reason for Rejection (Office Action) from the Japanese Patent Office, Japanese Patent Application No. 2012-532847, three (3) pages (from 12296).
Reason for Rejection (Office Action) from the Japanese Patent Office, Japanese Patent Application No. 2012-532847, Dead Jun. 17, 2015, seven (7) pages (from 12296).
Palaszewski, Bryan A., NASA Glenn Research Center, Safer Aircraft Possible with Nitrogen Generation, 2 pages, Mar. 2001.
Pyrogen: The New Revolution in Fire Suppression Technology" International Aircraft Systems, Fire Protection Working Group, Atlantic City, NJ. Aug. 29, 2000, 43 pages.
http://www.navair.navy.mil/techTrans/index.cfm?map=local.ccms.view.aB&doc=paper.4, pyrotechnic Fire Extinguishers" Navair-T2 Technology Transfer, printed May 18, 2009.
Saito, Naoshi, et al., "Flame-extinguishing Concentrations and Peak Concentrations of N2, Ar, Co2 and their Mixtures for Hydrocarbon Fuels," Fire Safety Journal, vol. 27, pp. 185-200, 1996.
Sampson, W. "Development of a 100% Solid Propellant Based Gas Generator Fire Suppression System," Halon Options Technical Working Conference (HOTWC) 16th Proceedings (May 2006), pp. 1-11.
Sampson, et al. "Extinguishing Mechanism for Solid Propellant Based Gas Generator Fire Suppression System," 2011 Suppression, Detection and Signaling Research and Applications—A Technical Working Conference (Mar. 2011), pp. 1-14.
Schmid, Helmut, et al., "Gas Generator Development for Fire Protection Purpose," Propellants, Explosives, Pyrotechnics, vol. 24, pp. 144-148, 1999.
TNO Defence, Security and Safety, "Solid Propellant Cool Gas Generators," 2 pages, unknown publication date.
Water Mist-Fire-Suppression Experiment" NASA Glenn Research Center, Dec. 2001, 3 pages.
Written Opinion for International Application No. PCT/US2011/055091, issued Jul. 9, 2012, 5 pages.
Yang, Jiann C., et al., "Solid Propellant Gas Generators: An Overview and Their Application to Fire Suppression," International Conference on Fire Research and Engineering, Sep. 10-15, 1995, Orlando, FL, 3 pages.
International Preliminary Examination Report for International Application No. PCT/CA03/01525 dated Jan. 17, 2005, 10 pages. (formerly cited as International Preliminary Examination Report, dated Jan. 17, 2005).
Office Action for Japanese Patent Application No. 2014-534523 dated Nov. 10, 2016, 5 pages.

* cited by examiner

FIRE SUPPRESSION SYSTEMS AND METHODS OF SUPPRESSING A FIRE

CROSS-REFERENCE TO RELATED APPLICATION

This application is a continuation of U.S. patent application Ser. No. 13/267,427, filed Oct. 6, 2011, now U.S. Pat. No. 8,967,284, issued Mar. 3, 2015, the disclosure of which is hereby incorporated herein in its entirety by this reference.

FIELD

Embodiments of the disclosure relate generally to fire suppression. Embodiments of the disclosure relate to fire suppression apparatuses having a gas generator and a cooling system and to methods of using such fire suppression apparatuses to suppress a fire. Embodiments of the disclosure also relate to methods of cooling a fire suppressant gas using a liquid coolant.

BACKGROUND

In the past, Halon halocarbons have found extensive application in connection with fire suppression. The term "Halon halocarbons" generally refers to haloalkanes, or halogenoalkanes, a group of chemical compounds consisting of alkanes with linked halogens and, in particular, to bromine-containing haloalkanes. Halon halocarbons are generally efficient in extinguishing most types of fires, desirably are electrically non-conductive, tend to dissipate rapidly without residue formation and to be relatively safe for limited human exposure. In the past, Halon halocarbons, such as the halocarbon Halon 1301 (bromotrifluoromethane, $CBrF_3$), have found utility as fire suppressants in or for areas or buildings typically not well suited for application of water sprinkler systems, areas such as data and computer centers, museums, libraries, surgical suites and other locations where application of water-based suppressants can result in irreparable damage to electronics, vital archival collections, or the like.

Halon halocarbons, however, have been found to have a detrimental impact on the environment due to an ozone depleting aspect with respect to the atmosphere.

SUMMARY

Fire suppression apparatuses are disclosed, including a housing having gas generant material disposed therein, an initiator configured to ignite at least a portion of the gas generant material to form gas, and a cooling system disposed adjacent the housing. The cooling system includes a first chamber with a coolant material disposed therein and a second chamber. Upon actuation, at least a portion of the coolant material flows from the first chamber into the second chamber to mix with and cool the gas formed by the ignition of the gas generant material. In some embodiments, the fire suppression apparatus further includes a piston disposed within the first chamber of the cooling system, the piston being movable within the first chamber to pressurize the coolant material and flow the coolant material from the first chamber into the second chamber. The coolant material may be a liquid.

Methods for suppressing a fire with a fire suppression apparatus are disclosed, including igniting a gas generant material to form a fire suppressant gas, flowing the fire suppressant gas into first and second chambers of a cooling system, and flowing a coolant material from the first chamber into the second chamber by forcing a piston to move in the first chamber with the fire suppressant gas. The coolant material may mix with and cool the fire suppressant gas. The mixture of the coolant material and the fire suppressant gas may be directed toward a fire.

Methods for cooling a fire suppressant gas are also disclosed, including flowing a fire suppressant gas into a first and second chamber, moving a piston operatively disposed in the first chamber by pushing against the piston with the fire suppressant gas, flowing a coolant material from the first chamber into the second chamber by pushing against the coolant material with the piston, and mixing the coolant material and the fire suppressant gas in the second chamber.

DETAILED DESCRIPTION

FIGS. 1 through 8 illustrate portions of embodiments of a fire suppression apparatus of the present disclosure. Fire suppression apparatuses of the present disclosure include a gas generator (see FIGS. 1-3) and a cooling system (see FIGS. 4A-8) configured to cool a fire suppressant gas generated by the gas generator.

Figure 1:
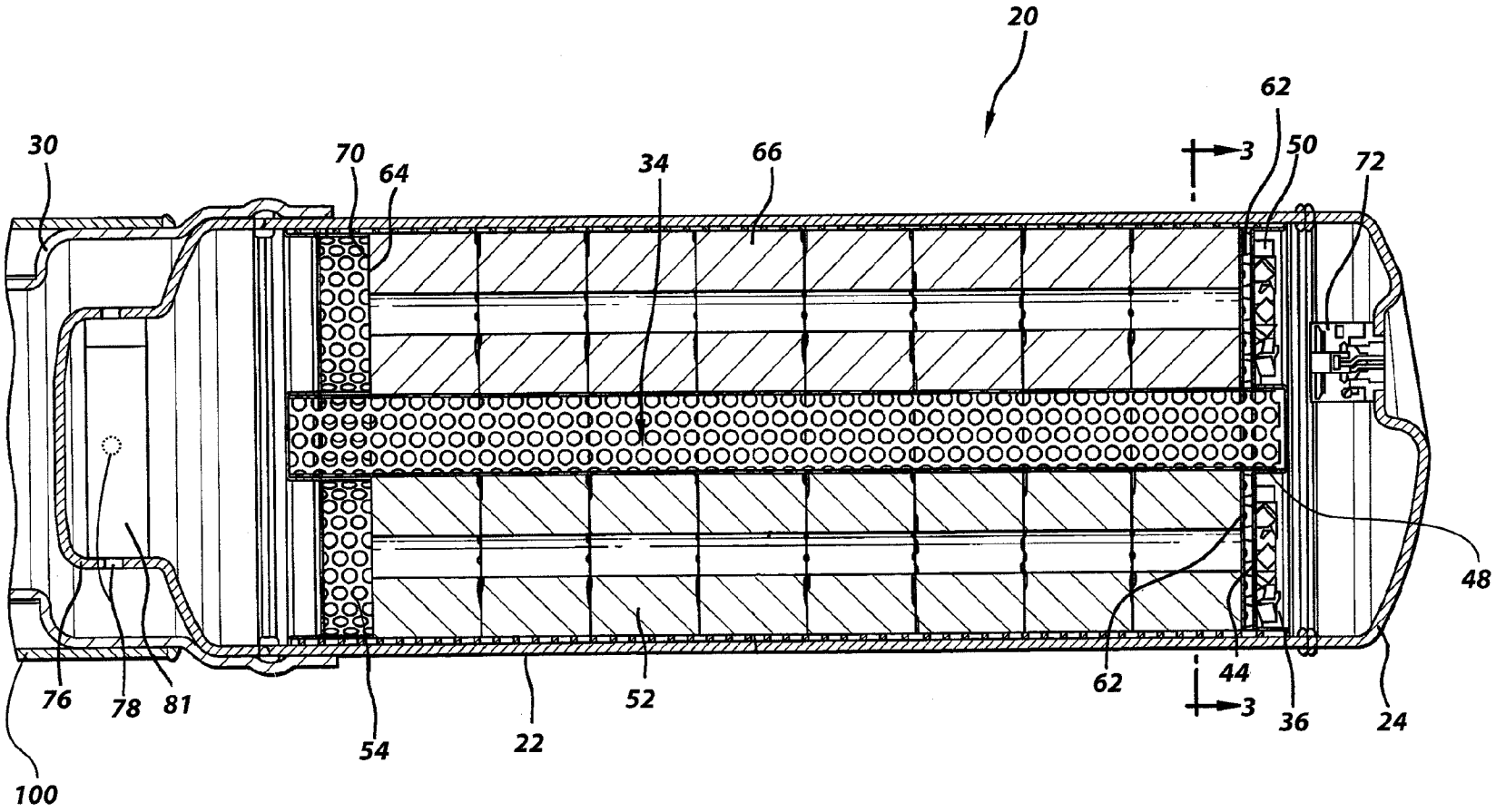
FIG. 1 is a cross-sectional view of a gas generator of a fire suppression apparatus according to an embodiment of the present disclosure.

FIG. 1 shows a cross-sectional view of an embodiment of a gas generator 20 of a fire suppression apparatus of the present disclosure. The gas generator 20 includes a generator housing 22, a first end wall 24 positioned at a first longitudinal end of the generator housing 22, and a second end wall 76 positioned at a second longitudinal end of the generator housing 22 opposite the first longitudinal end. The generator housing 22, first end wall 24, and second end wall 76 may each be formed of a material able to withstand elevated temperatures and/or pressures produced during actuation of the gas generator 20. For example, the generator housing 22, first end wall 24, and second end wall 76 may each be formed of one or more of a metal (e.g., steel), a polymer, a composite (e.g., a fibrous composite), and a ceramic. The first and second end walls 24, 76, may be formed integrally with the generator housing 22 or formed separately and attached to the generator housing 22 by way of, for example, a weld, an adhesive, a crimp, threads, mechanical fasteners, a press fit, etc.

A gas generant material 52 may be disposed within the generator housing 22 for generating a gas (e.g., a fire suppressant gas). Materials that may be used for the gas generant material 52 include, for example, materials known in the art of inflatable vehicular occupant safety restraint systems (e.g., airbag systems). Compositions suitable for gas generant material 52 are known to those of ordinary skill in the art and may differ depending upon the intended application for the generated gas. For use in fire suppression, particularly for human-occupied areas, the gas generant material 52 of gas generant wafers 66 may be an HACN composition, as disclosed in U.S. Pat. Nos. 5,439,537, 5,673,935, 5,725,699, and 6,039,820 to Hinshaw et al., the disclosure of each of which patents is incorporated by reference herein. The HACN used in the gas generant material 52 may be recrystallized and include less than approximately 0.1% activated charcoal or carbon. By maintaining a low amount of carbon in the gas generant material 52, the amount of carbon-containing gases, such as CO, $CO_2$, or mixtures thereof, may be minimized upon combustion of the gas generant material 52. Alternatively, a technical grade HACN having up to approximately 1% activated charcoal or carbon may be used. It is also contemplated that conventional gas generant materials that produce gaseous combustion products that do not include carbon-containing gases or $NO_x$ may also be used.

The HACN composition, or other gas generant material 52, may include additional ingredients, such as at least one of an oxidizing agent, ignition enhancer, ballistic modifier, slag enhancing agent, cooling agent, a chemical fire suppressant, inorganic binder, or an organic binder. By way of example, the HACN composition may include at least one of cupric oxide, titanium dioxide, guanidine nitrate, strontium nitrate, and glass. Many additives used in the gas generant material 52 may have multiple purposes. For sake of example only, an additive used as an oxidizer may provide cooling, ballistic modifying, or slag enhancing properties to the gas generant material 52. The oxidizing agent may be used to promote oxidation of the activated charcoal present in the HACN or of the ammonia groups coordinated to the cobalt in the HACN. The oxidizing agent may be an ammonium nitrate, an alkali metal nitrate, an alkaline earth nitrate, an ammonium perchlorate, an alkali metal perchlorate, an alkaline earth perchlorate, an ammonium peroxide, an alkali metal peroxide, or an alkaline earth peroxide. The oxidizing agent may also be a transition metal-based oxidizer, such as a copper-based oxidizer, that includes, but is not limited to, basic copper nitrate ($[Cu_2(OH)_3NO_3]$) ("BCN"), $Cu_2O$, or CuO. In addition to being oxidizers, the copper-based oxidizer may act as a coolant, a ballistic modifier, or a slag enhancing agent. Upon combustion of the gas generant 52, the copper-based oxidizer may produce copper-containing combustion products, such as copper metal and cuprous oxide, which are miscible with cobalt combustion products, such as cobalt metal and cobaltous oxide. These combustion products produce a molten slag, which fuses at or near the burning surface of the wafer 66 and prevents particulates from being formed. The copper-based oxidizer may also lower the pressure exponent of the gas generant material 52, decreasing the pressure dependence of the burn rate. Typically, HACN-containing gas generants material that include copper-based oxidizers ignite more readily and burn more rapidly at or near atmospheric pressure. However, due to the lower pressure dependence, they burn less rapidly at extremely high pressures, such as those greater than approximately 3000 psi.

The gas generant material 52 may, by way of example, be a solid material that is formed as wafers 66 that are generally cylindrical. The wafers 66 of gas generant material 52 may each have one or more holes therethrough to provide improved ignition of the gas generant material 52 and increased gas flow through the gas generator 20 upon actuation thereof. The wafers 66 of gas generant material 52 may be arranged in one or more stacks, as shown in FIG. 1. Each stack of wafers 66 may be disposed at least partially within a gas generant container 54. Each gas generant container 54 may be generally cylindrical and contain perforations therethrough for improving gas flow and ignition of the gas generant material 52. A space 34 may be provided between each gas generant container 54 to enable gas to flow therethrough upon actuation of the gas generator 20. Any number of gas generant containers 54 may be disposed within the generator housing 22. The number of gas generant containers 54 and, therefore, the quantity of gas generant material 52, may be modified to, for example, tailor the amount of fire suppression provided, the cost of the fire suppression apparatus, the weight of the fire suppression apparatus, etc.

Figure 2:
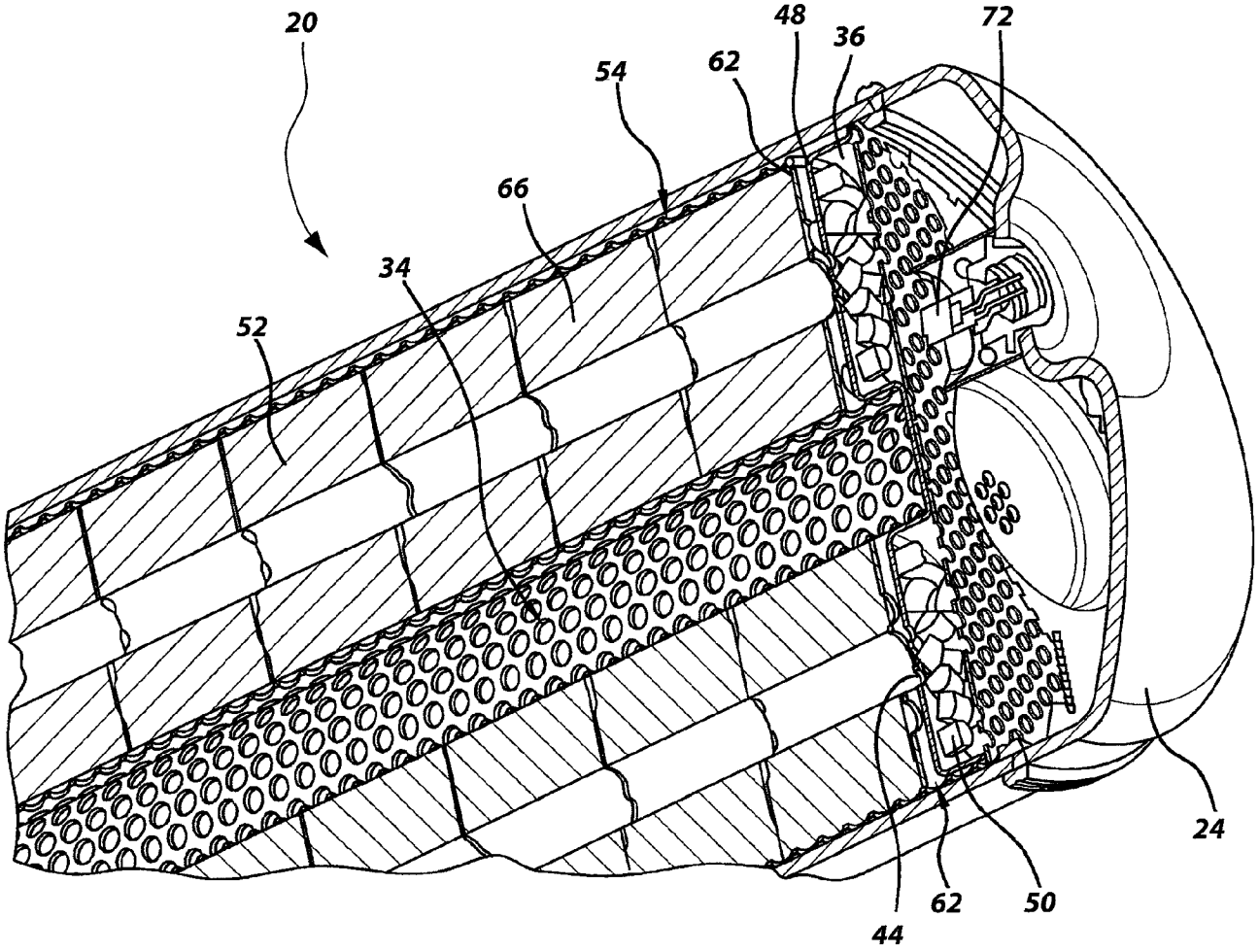
FIG. 2 is a cross-sectional perspective view of the gas generator shown in FIG. 1.

Referring to FIG. 1 in conjunction with FIG. 2, the wafers 66 of gas generant material 52 may be held in place within the gas generant container 54 with a first retainer disk 62 at one end of the gas generant container 54 and a second retainer disk 64 disposed at an opposite end of the gas generant container 54. The first and second retainer disks 62, 64 may each have one or more openings therethrough for enabling flow of ignition products and/or gas therethrough. Optionally, additional retainer disks (not shown) may be disposed between each wafer 66 of gas generant material 52.

Figure 3:
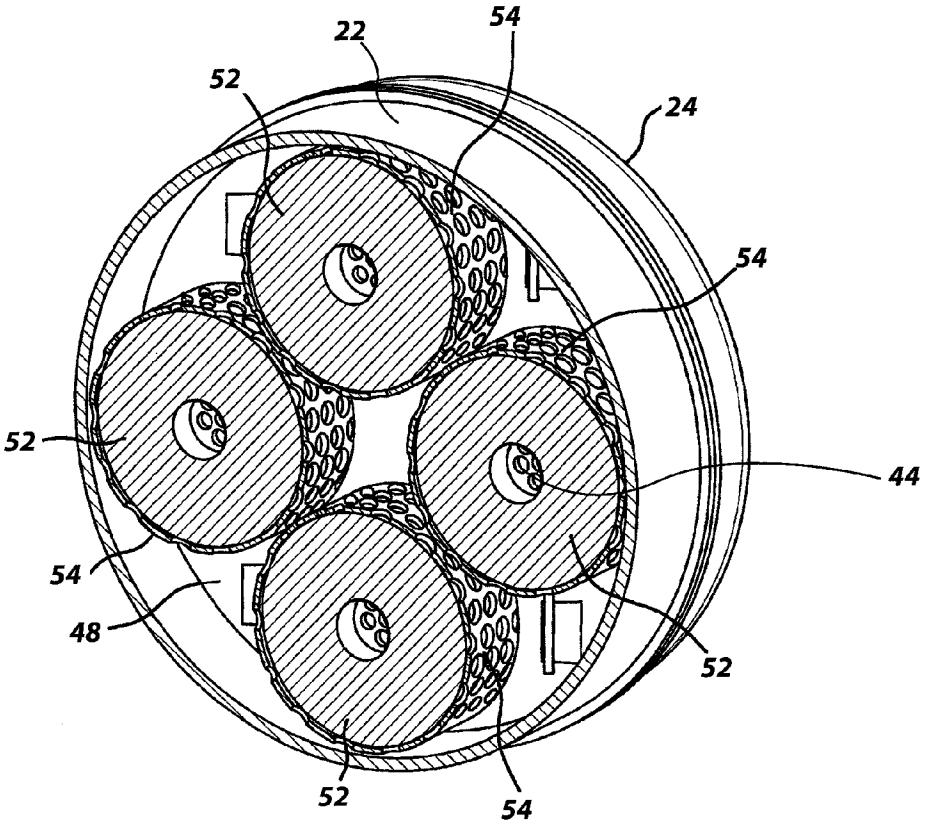
FIG. 3 is a cross-sectional perspective view of a portion of the gas generator shown in FIG. 1, taken along the line 3-3 as shown in FIG. 1.

As shown in FIGS. 1 through 3, a first retainer plate 48 may be positioned within the generator housing 22 proximate the first end wall 24, and a second retainer plate 70 may be positioned within the generator housing 22 proximate the second end wall 76. The first and second retainer plates 48, 70 may be configured to hold the gas generant containers 54 in place within housing 22 of the gas generator 20. The first retainer plate 48 may include a recess 36 in which an ignition material 50 may be disposed. The first retainer plate 48 may include holes 44 therethrough to allow ignition products to pass therethrough for igniting the gas generant material 52 upon actuation of the gas generator 20. Actuation of the gas generator 20 may occur through actuation of an igniter 72 positioned proximate the first end wall 24 and positioned proximate at least a portion of the ignition material 50. By way of example, the igniter 72 may be an electronic igniter configured to ignite when, for example, a fire alarm is activated. Thus, when the igniter 72 is actuated, the ignition material 50 is ignited and, consequently, the gas generant material 52 is ignited and combusts to generate a fire suppressant gas. In other words, the gas generant material 52 may react to form a fire suppressant gas upon contact with ignition products of the ignition material 50.

Referring again to FIG. 1, the second end wall 76 may include openings 78 for enabling the fire suppressant gas generated by the gas generant material 52 to flow therethrough and out of the gas generator 20. A barrier 81 may be positioned over the openings 78 in the second end wall 76 to prevent passage of materials through the openings 78 before the gas generator 20 is actuated, and to enable a pressure increase within the gas generator 20 so that combustion of the gas generant material 52 becomes self-sustaining. The barrier 81 may be a pressure-sensitive barrier configured to rupture when sufficient pressure is applied thereto, thus allowing passage of the fire suppressant gas generated by the combusting gas generant material 52 through the openings 78 when the gas generator 20 is actuated. By way of example, the barrier 81 may be a foil band or tape and may be chosen to rupture at a predetermined pressure above ambient pressure outside of the gas generator 20.

Although a particular embodiment of a gas generator 20 is shown with reference to FIGS. 1 through 3, the disclosure is not so limited. By way of example, any source of fire suppressant gas or other fire suppressant material that may require removal of heat from a fire suppressant material stream for a particular application may be used with cooling systems of the present disclosure.

Figure 4A:
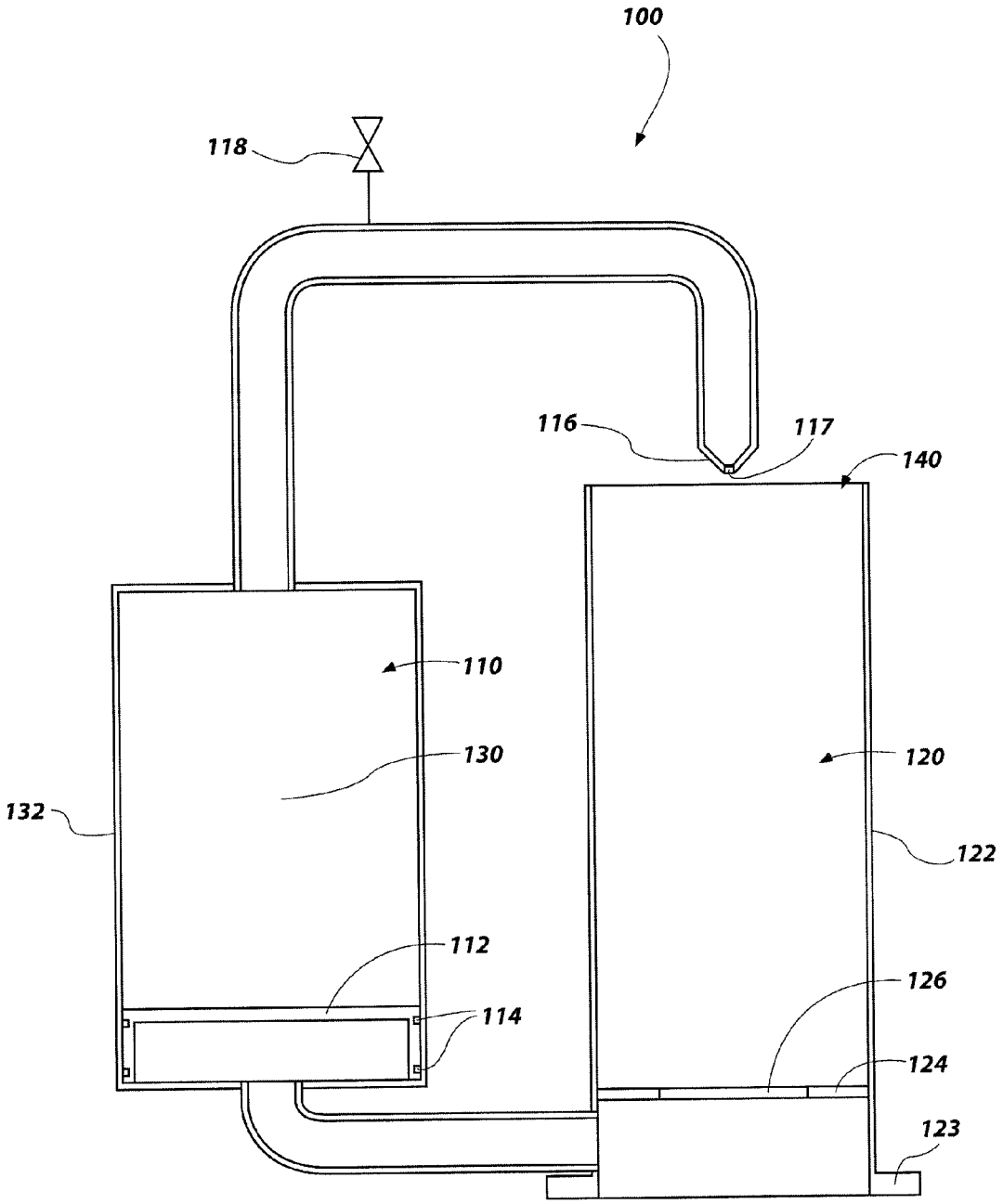
FIGS. 4A through 4C show cross-sectional views of a cooling system of a fire suppression apparatus according to an embodiment of the present disclosure.
Figure 4B:
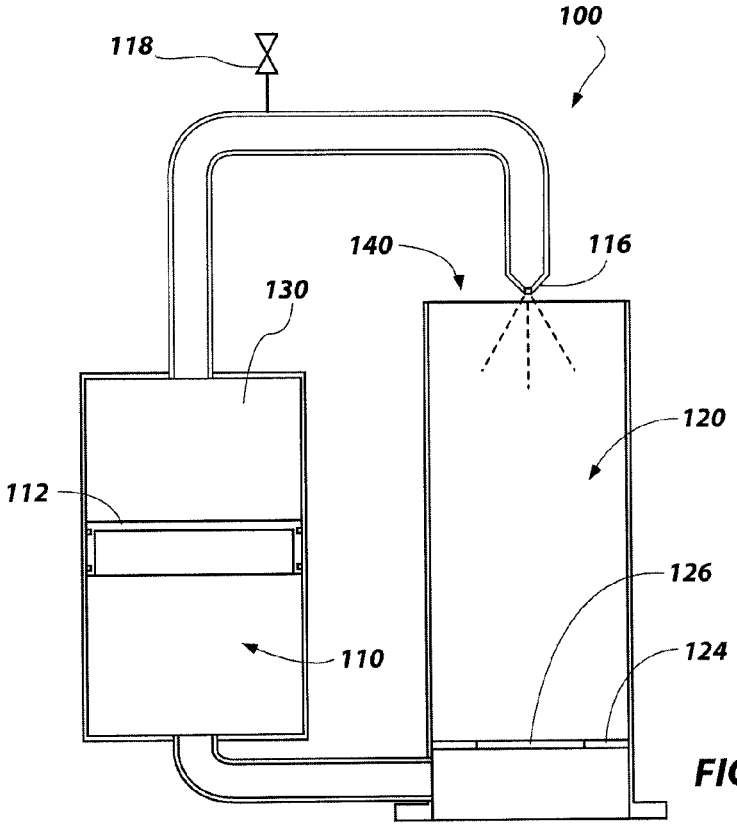
Figure 4C:
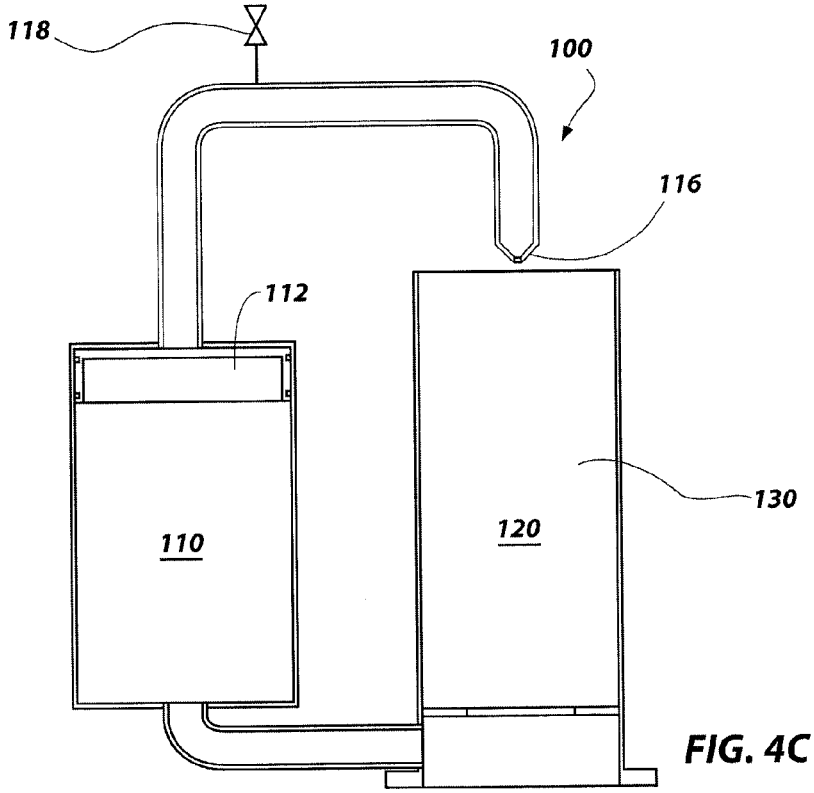

As can be seen in FIG. 1, the gas generator 20 may be coupled to a cooling system, such as the cooling system 100 described in more detail below (FIGS. 4A through 4C). A connection element 30 may, optionally, be disposed between the gas generator 20 and the cooling system 100. In other embodiments, the cooling system 100 may be connected directly to the gas generator 20, such as by a weld, a crimp, a press fit, threads, an adhesive, mechanical fasteners, etc. Thus, fire suppressant gas generated by the gas generator 20 may pass through the openings 78 in the second end wall 76 of the gas generator 20 and into the cooling system 100, as described in more detail below.

Although the views of FIGS. 4A through 8 do not show a gas generator, it is to be understood that a gas generator as described above may be positioned adjacent the cooling systems of FIGS. 4A through 8 so that fire suppressant gas generated by and exiting from the gas generator may be cooled by the cooling systems. For example, the gas generator 20 described above may be attached to any of the cooling systems of FIGS. 4A through 8 at the bottom of the cooling systems, when viewed in the perspectives of FIGS. 4A through 8. Thus, gas may exit the gas generator 20 through the openings 78 and into any of the cooling systems 100, 200, 300, 400, 500 to flow therethrough and to be cooled, as will be described in more detail below.

Referring now to FIG. 4A, a cooling system 100 of a fire suppression apparatus is shown and described. The cooling system 100 may include a first chamber 110 defined at least in part by a first housing 132. The first chamber 110 includes a piston 112 disposed therein and configured to move within the first chamber 110 upon application of sufficient force (e.g., pressure) against the piston 112. One or more seals 114 (e.g., O-rings) may be disposed between the piston 112 and the first housing 132 to inhibit fluid communication around the piston 112. A coolant material 130 may be disposed within the first chamber 110. The coolant material 130 may be provided in the first chamber 110 through, for example, a fill port 118. The coolant material 130 may be in liquid form at least prior to operation of the cooling system 100. However, during operation of the cooling system 100, at least a portion of the coolant material 130 may vaporize to form a gaseous material, as will be described in more detail below. During operation, the coolant material 130 may flow out of the first chamber 110 through a nozzle 116. The nozzle 116 may be covered or closed by a pressure-sensitive barrier 117, such as a foil, as described above with reference to the barrier 81 of FIG. 1.

The cooling system 100 may include a second chamber 120 defined at least in part by a second housing 122. The second housing 122 may optionally include a flange 123 for connection to the gas generator 20. A plate 124 with at least one opening 126 therethrough may be disposed within the second housing 122. The second housing 122 may include at least one opening 140 for discharging fire suppressant gas therethrough, such as to suppress a fire.

FIGS. 4B and 4C illustrate the cooling system 100 in operation. As fire suppressant gas is generated by the gas generator 20 (FIGS. 1-3) coupled to the cooling system 100, the fire suppressant gas may exit the housing 22 (FIG. 1) and flow into the cooling system 100. The fire suppressant gas may flow against a structure in the form of the plate 124, increasing pressure of the fire suppressant gas exiting the housing 22 upstream of plate 124. Such an increased pressure may act more effectively on the coolant material 130 in the first chamber 110 through the piston 112. In other words, the pressure of the fire suppressant gas may push against the piston 112 in the first chamber 110, forcing the piston 112 to move in the first chamber 110 and to press against the coolant material 130. Thus, the size of the plate 124 and the corresponding openings 126 can be tailored to cause sufficient pressure to move the piston 112. Due to the movement of the piston 112, the coolant material 130 may pressurize and break the barrier 117 (FIG. 4A) covering the nozzle 116, causing the coolant material 130 to flow into the second chamber 120 of the cooling system 100. At least a portion of the fire suppressant gas may flow through the at least one opening 126 in the plate 124 and into the second chamber 120. The coolant material 130 flowing through the nozzle 116 may contact and cool the fire suppressant gas flowing through the second chamber 120. Depending on the materials (e.g., the coolant material 130 and the fire suppressant gas) and conditions (e.g., temperature, pressure, etc.) involved, at least a portion of the coolant material 130 may vaporize and become a mist or even substantially gaseous upon exiting the nozzle 116 and contacting the fire suppressant gas. Such a phase change may remove heat from the fire suppressant gas and therefore may enhance the cooling thereof. Thus, a combination of fire suppressant gas and coolant material 130 (in a liquid, gaseous, or a combination of liquid and gaseous form) may be expelled from the cooling system 100 through the opening 140 at a reduced temperature compared to a temperature of the fire suppressant gas exiting the gas generator 20 and entering the cooling system 100. The reduced temperature of the fire suppressant gas may enhance the fire suppression thereof and may reduce or eliminate harm (e.g., burns) to people who may be proximate the fire suppression system when it is actuated.

As can be seen in FIG. 4C, the piston 112 may continue to move through the first chamber 110 forcing the coolant material 130 to flow into the second chamber 120 until either the pressure from the fire suppressant gas pushing against the piston 112 is sufficiently reduced or substantially all of the liquid coolant material 130 is forced out of the first chamber 110.

Various materials may be used as the coolant material 130. In one embodiment, the coolant material 130 may include at least one endothermically alterable material. The endothermically alterable material may include a liquid that may vaporize and/or decompose upon contact with the fire suppressant gas generated by the ignition of the gas generant 52, which may cool the fire suppressant gas.

In some embodiments, the endothermically alterable material may endothermically decompose and/or vaporize to form additional gaseous products, thus increasing the resulting quantity of gaseous products. Such an increase in the quantity of gaseous products may reduce the quantity of the gas generant material 52 required for proper functioning of the fire suppression apparatus. By reducing the required quantity of gas generant material 52, the size of the gas generator 20 of the fire suppression apparatus may be reduced, thus reducing the cost and/or size of the fire suppression apparatus and/or increasing the fire suppression capability of the fire suppression apparatus.

Suitable coolant materials 130 may include liquid materials that remain a liquid at ambient temperatures in which the fire suppression apparatus may operate (e.g., between about −35° C. and about 85° C.). Furthermore, any products formed from the coolant material 130 may be within acceptable effluent limits associated with particular fire suppression applications. Also, the coolant material 130 may be non-corrosive to facilitate storage in the first chamber 110. Examples of coolant materials 130 that generally meet such criteria include water mixed with calcium chloride ($CaCl_2$) and water mixed with propylene glycol.

In addition to or as a part of the coolant material 130, the first chamber 110 may include one or more active fire suppression compounds that are generally useful for suppressing a fire upon contact therewith. Examples of chemically active fire suppression compounds that may be used include potassium acetate and alkali metal bicarbonates.

For example, a solution of 30% by weight potassium acetate in water can reduce the quantity of gas generant 52 required and generator housing 22 size and weight of a subject fire suppression apparatus by about 40% without significantly changing either the size of the first chamber 110 or the fire suppression capability of the fire suppression apparatus, as compared to an otherwise similar apparatus lacking the potassium acetate solution.

Figure 5:
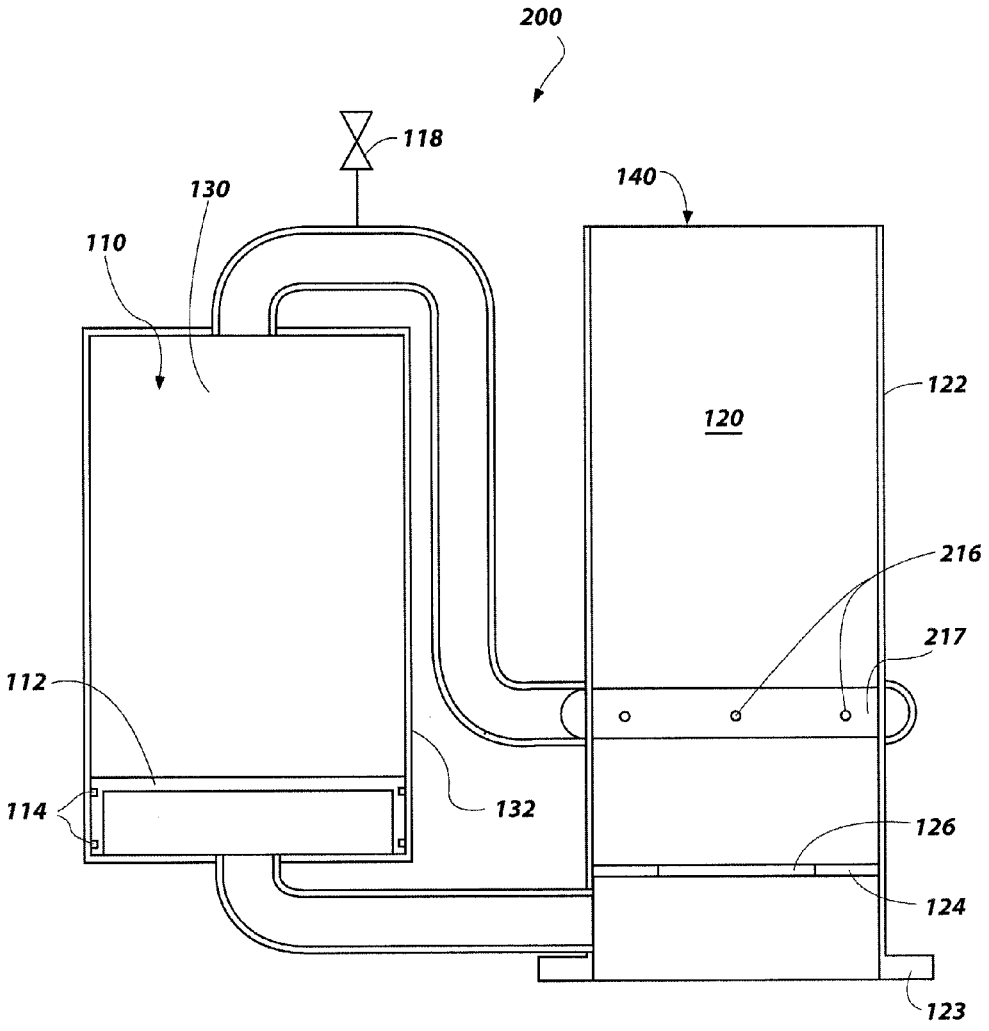
FIG. 5 shows a cross-sectional view of a cooling system of a fire suppression apparatus according to another embodiment of the present disclosure.

Another embodiment of a cooling system 200 of a fire suppression apparatus of the present disclosure is shown in FIG. 5. The cooling system 200 of FIG. 5 is similar to the cooling system 100 shown in FIGS. 4A through 4C and may include a first chamber 110 defined at least in part by a first housing 132, a second chamber 120 defined at least in part by a second housing 122, and a piston 112 disposed within the first chamber 110. The first chamber 110 may be at least partially filled with a coolant material 130, provided, for example, through a fill port 118. At least one seal 114 (e.g., O-ring) may be disposed around the piston 112 to inhibit fluid flow around the piston 112. The second housing 122 may include a flange 123 for connection with a gas generator (e.g., the gas generator 20 described above), a plate 124 with at least one opening 126 therethrough, and an opening 140 for discharging fire suppressant gas therethrough. However, the cooling system 200 differs from the cooling system 100 of FIGS. 4A through 4C in that it includes one or more openings 216 positioned radially around the second housing 122 for injecting the coolant material 130 therein. The one or more openings 216 may be covered by a pressure-sensitive barrier 217, such as a foil band, as described above with reference to the barriers 81 and 117.

The cooling system 200 may operate in a similar manner to that described with reference to FIGS. 4A through 4C in that the fire suppressant gas entering the cooling system 200 may press against the piston 112, causing it to move within the first chamber 110. Pressurized coolant material 130 may rupture the barrier 217, enabling coolant material 130 to flow into the second chamber 120 through the one or more openings 216 to mix with and cool the fire suppressant gas. However, the position of the one or more openings 216 radially around the second housing 122 may enable modified mixing and cooling characteristics, compared to the position of the nozzle 116 shown in FIGS. 4A through 4C.

Although FIGS. 4A through 5 show embodiments of a cooling system 100, 200 with a first chamber 110 at least partially defined by a first housing 132 positioned laterally adjacent a second chamber 120 at least partially defined by a second housing 122, the present disclosure is not so limited. For example, the first chamber 110 may be at least partially disposed within the second housing 122 of the second chamber 120. By way of another example, the second chamber 120 may be at least partially disposed within the first housing 132. By way of yet another example, the first chamber 110 may at least partially laterally surround the second chamber 120. Further example embodiments of cooling systems 300, 400, 500 of the present disclosure are shown in FIGS. 6A through 8 and described in more detail below.

Figure 6B:
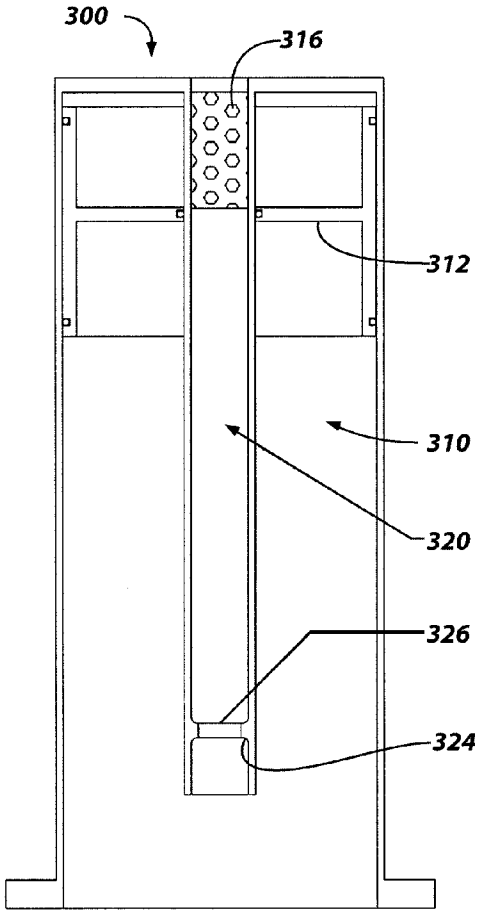
FIGS. 6A and 6B show cross-sectional views of a cooling system of a fire suppression apparatus according to another embodiment of the disclosure.
Figure 6A:
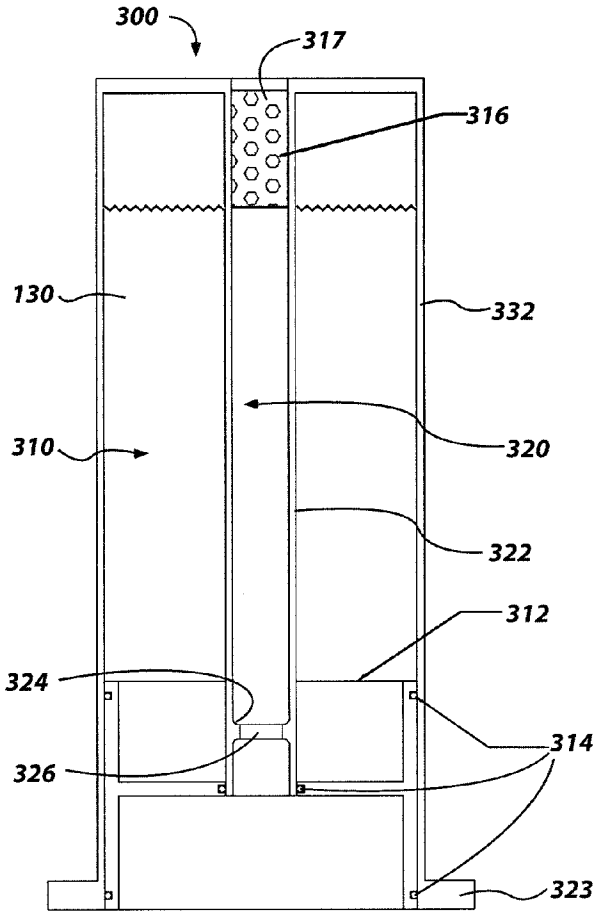

Referring to FIG. 6A, a cooling system 300 may include a first chamber 310 defined at least in part by a first housing 332 with coolant material 130 disposed therein. A second chamber 320 defined at least in part by a second housing 322 may be at least partially disposed within the first housing 332 and the first chamber 310. A piston 312 may be disposed within the first chamber 310 and may laterally surround a portion of the second housing 322 defining the second chamber 320. One or more seals 314 (e.g., O-rings) may be disposed between the piston 312 and the first housing 332 and between the piston 312 and the second housing 322, to inhibit fluid communication around the piston 312. The first housing 332 may include a flange 323 for connection with a gas generator. A plate 324 with at least one opening 326 therethrough may be positioned within the second chamber 320. The second housing 322 may include one or more openings 316 therethrough providing fluid communication between the first and second chambers 310, 320. The one or more openings 316 may be covered by a pressure-sensitive barrier 317, such as a foil band, to inhibit fluid communication through the one or more openings 316 when the cooling system 300 is not in operation.

As can be seen in FIGS. 6A and 6B, when fire suppressant gas is introduced into the bottom of the cooling system 300 (when viewed in the perspective of FIGS. 6A and 6B), the fire suppressant gas may push against the piston 312, forcing it to move through the first chamber 310. At least some of the fire suppressant gas may flow through the one or more openings 326 in the plate 324 and into the second chamber 320. The movement of the piston 312 may force the coolant material 130 to rupture the barrier 317 and flow into the second chamber 320 to mix with and cool the fire suppressant gas flowing therethrough. Thus, as described above, the fire suppressant gas may be cooled by the coolant material 130 before and/or after being discharged from the cooling system 300.

Figure 7:
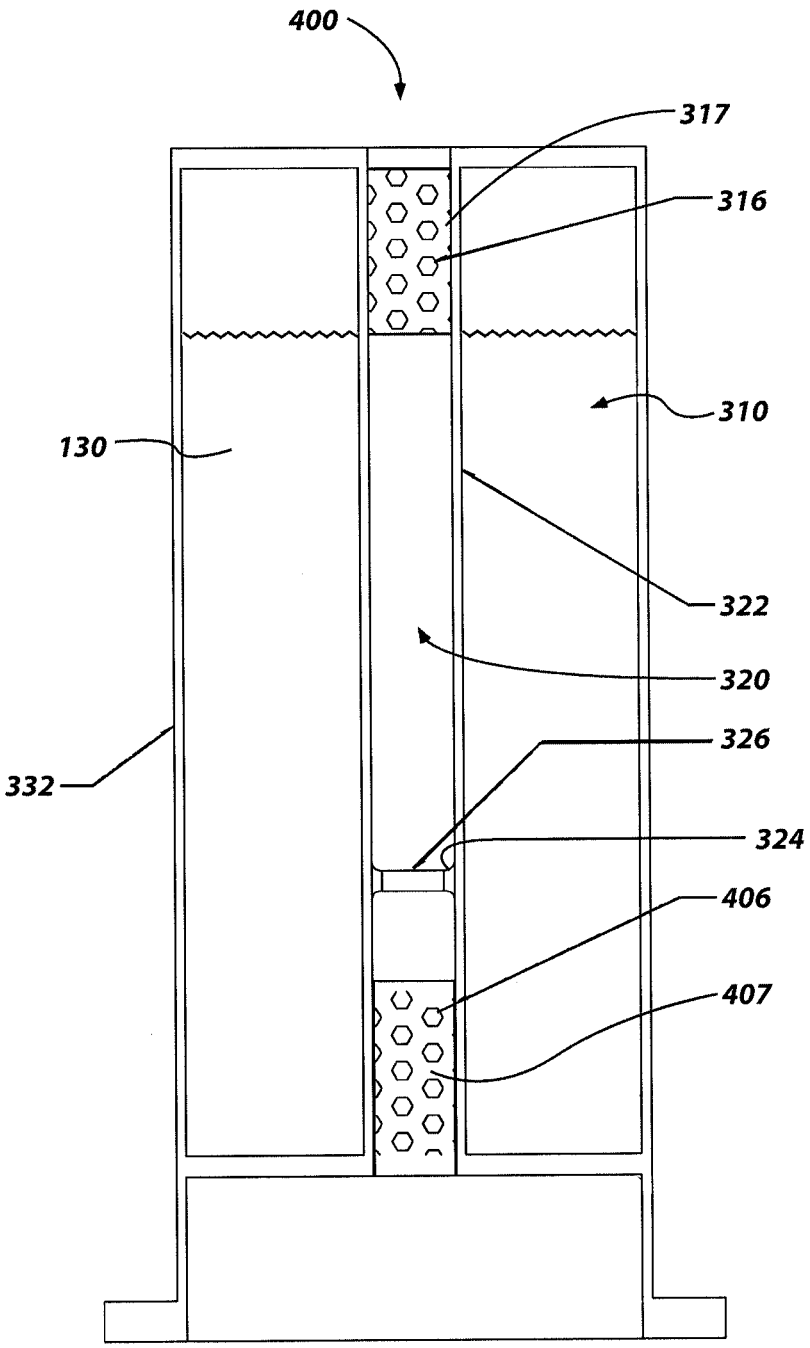
FIG. 7 shows a cross-sectional view of a cooling system of a fire suppression apparatus according to yet another embodiment of the present disclosure.

FIG. 7 shows another embodiment of a cooling system 400 of a fire suppression apparatus of the present disclosure. The cooling system 400 shown in FIG. 7 is similar to the cooling system 300 shown in FIGS. 6A and 6B and may include a first chamber 310 defined at least in part by a first housing 332 that at least partially laterally surrounds a second chamber 320 defined at least in part by a second housing 322. The coolant material 130 may be disposed within the first chamber 310. One or more openings 316 may extend through the second housing 322 to provide fluid communication between the first and second chambers 310, 320. A barrier 317 may cover the one or more openings 316, as described above. A plate 324 with at least one opening 326 therethrough may be positioned within the second chamber 320. However, the cooling system 400 does not include a piston. Rather, the cooling system 400 may include additional one or more openings 406 through the second housing 322 covered by another barrier 407, the another barrier 407 similar to the barriers 81, 117, 217, 317 described above. The additional one or more openings 406 may be positioned in the flowpath before the plate 324 so that fire suppressant gas flowing through the cooling system 400 may rupture the another barrier 407 and enter the first chamber 310 to pressurize the first chamber 310 and cause the coolant material 130 to rupture the barrier 317 and flow into the second chamber 320 through the openings 316. Thus, the coolant material 130 may mix with and cool fire suppressant gas flowing through the second chamber 320, as described above, before being discharged from the cooling system 400.

Figure 8:
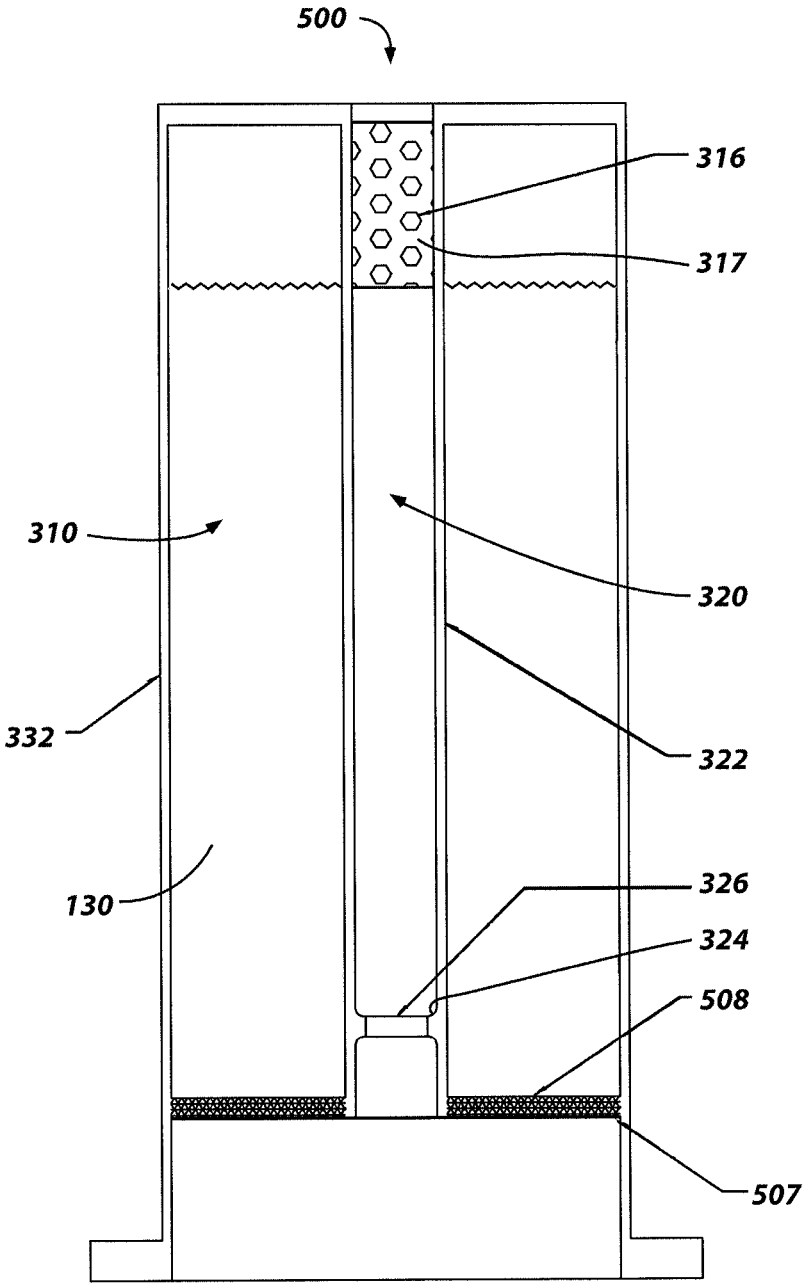
FIG. 8 shows a cross-sectional view of a cooling system of a fire suppression apparatus according to an additional embodiment of the present disclosure.

FIG. 8 shows another embodiment of a cooling system 500 of a fire suppression apparatus of the present disclosure. The cooling system 500 shown in FIG. 8 is similar to the cooling system 300 shown in FIGS. 6A and 6B and may include a first chamber 310 defined at least in part by a first housing 332 that at least partially laterally surrounds a second chamber 320 defined at least in part by a second housing 322. The coolant material 130 may be disposed within the first chamber 310. One or more openings 316 extend through the second housing 322 to provide fluid communication between the first and second chambers 310, 320. A barrier 317 may cover the one or more openings 316, as described above. A plate 324 with at least one opening 326 therethrough may be positioned within the second chamber 320. However, the cooling system 500 does not include a piston. Rather, the cooling system 500 may include a perforated plate 508 disposed at a longitudinal end of the first chamber 310 closest to a source of fire suppressant gas (e.g., a gas generator 20, as described above). Perforations of the perforated plate 508 may be referred to as at least one additional opening. An additional barrier 507, similar to the barriers 81, 117, 217, 317, 407 described above, may cover the perforated plate 508. Fire suppressant gas flowing through the cooling system 500 may rupture the additional barrier 507 and enter the first chamber 310 through the perforated plate 508. The fire suppressant gas may pressurize the first chamber 310 and cause the coolant material 130 to rupture the barrier 317 and flow into the second chamber 320 through the openings 316. Thus, the coolant material 130 may mix with and cool fire suppressant material flowing through the second chamber 320, as described above, before being discharged from the cooling system 500.

The present disclosure includes methods for cooling a fire suppressant gas. A fire suppressant gas may be flowed into a first chamber and a second chamber of a cooling system. The first chamber and the second chamber may be proximate each other. The fire suppressant gas may push against a piston in the first chamber to move the piston, causing a coolant material within the first chamber to flow from the first chamber into the second chamber. The coolant material may mix with the fire suppressant gas in the second chamber to cool the fire suppressant gas. The cooling of the fire suppressant gas may occur as described above with reference to any of FIGS. 4A through 8.

The present disclosure also includes methods for suppressing a fire. Such methods may include generating a fire suppressant gas with a gas generant material, as described above, and cooling the fire suppressant gas. The fire suppressant gas may be cooled by flowing the fire suppressant gas through a cooling system. The fire suppressant gas may force a coolant material to flow from a first chamber into a second chamber to mix with and cool the fire suppressant gas. In some embodiments, the fire suppressant gas may force a piston to move within the first chamber to pressurize the coolant material and flow it through a nozzle or an opening into the second chamber. After the coolant material and the fire suppression gas mix, the resulting mixture may be discharged from the second chamber. The mixture may be directed toward a fire and/or discharged in a space in which a fire exists to suppress the fire. The fire suppressant gas may be generated as described above with reference to FIGS. 1 through 3. The fire suppressant gas may be cooled as described above with reference to any of FIGS. 4A through 8.

While the disclosure is susceptible to various modifications and alternative forms, specific embodiments have been shown by way of example in the drawings and have been described in detail herein. However, the disclosure is not intended to be limited to the particular forms disclosed. Rather, the disclosure encompasses all modifications, combinations, equivalents, and alternatives falling within the scope of the invention as defined by the following appended claims and their legal equivalents.

What is claimed is:

1. A fire suppression system, comprising:

a generator housing having a gas generant material disposed therein; and a cooling system disposed adjacent to the generator housing, the cooling system comprising:

a first chamber having a coolant material disposed therein;

a second chamber at least partially laterally surrounded by the first chamber;

one or more first openings into a first longitudinal end of the first chamber;

a first pressure-sensitive barrier covering the one or more first openings;

one or more second openings between a second longitudinal end of the first chamber and the second chamber;

a second pressure-sensitive barrier covering the one or more second openings; and a plate including at least one third opening therethrough positioned in the second chamber between the one or more first openings and the one or more second openings.

2. The fire suppression system of claim 1, wherein the first chamber is defined at least in part by a first housing and the second chamber is defined at least in part by a second housing positioned within the first housing.

3. The fire suppression system of claim 2, wherein the one or more first openings into the first longitudinal end of the first chamber extend through a wall of the second housing.

4. The fire suppression system of claim 2, wherein the one or more second openings between the second longitudinal end of the first chamber and the second chamber extend through a wall of the second housing.

5. The fire suppression system of claim 1, wherein the first chamber is at least partially defined by a perforated plate disposed at the first longitudinal end of the first chamber.

6. The fire suppression system of claim 5, wherein the one or more first openings comprise perforations of the perforated plate, and the first pressure-sensitive barrier covers the perforated plate.

7. The fire suppression system of claim 1, wherein the cooling system does not include a piston.

8. The fire suppression system of claim 1, wherein each of the first pressure-sensitive barrier and the second pressure-sensitive barrier comprises a foil that is configured to rupture at a predetermined pressure above ambient pressure outside of the fire suppression system.

9. A fire suppression system, comprising:

a generator housing having a solid gas generant material and an ignition material disposed therein; and a cooling system coupled to the generator housing, the cooling system comprising:

a first, outer housing at least partially defining a first chamber therein;

a second housing at least partially defining a second chamber therein, the second housing positioned generally centrally within the first chamber;

a coolant material disposed within the first chamber and at least partially surrounding the second housing;

a first barrier covering one or more first openings into the first chamber positioned and sized to provide fluid communication to the first chamber from the generator housing;

a second barrier covering one or more second openings positioned and sized to provide fluid communication between the first chamber and the second chamber; and a plate having at least one third opening therethrough positioned within the second chamber, wherein the one or more first openings are positioned in a generated gas flowpath upstream of the plate and the one or more second openings are positioned in the generated gas flowpath downstream of the plate.

10. The fire suppression system of claim 9, wherein each of the generator housing and the first, outer housing is cylindrical.

11. The fire suppression system of claim 10, wherein the first, outer housing is aligned generally coaxially with the generator housing.

12. A method of suppressing a fire, the method comprising:

generating a fire suppressant gas with a gas generant material disposed in a generator housing;

directing the generated gas to a cooling system disposed adjacent to the generator housing;

rupturing, responsive to pressure from the generated gas, a first pressure-sensitive barrier covering one or more first openings into a first longitudinal end of a first chamber of the cooling system;

directing a portion of the generated gas into the first chamber though the one or more first openings;

rupturing, responsive to pressure from the generated gas acting on a coolant material in the first chamber, a second pressure-sensitive barrier covering one or more second openings between a second longitudinal end of the first chamber and a second chamber of the cooling system at least partially surrounded by the first chamber; and directing at least a portion of the coolant material from the first chamber to the second chamber through the one or more second openings without moving a piston.

13. The method of claim 12, further comprising directing another portion of the generated gas through the second chamber.

14. The method of claim 13, wherein directing the another portion of the generated gas through the second chamber comprises directing the another portion of the generated gas through a plate having at least one opening therethrough positioned within the second chamber.

15. The method of claim 13, further comprising mixing the at least a portion of the coolant material with the another portion of the generated gas directed through the second chamber.

16. The method of claim 12, wherein rupturing, responsive to pressure from the generated gas, the first pressure-sensitive barrier covering the one or more first openings into the first longitudinal end of the first chamber of the cooling system comprises rupturing the first pressure-sensitive barrier covering perforations of a perforated plate positioned at the first longitudinal end of the first chamber.

17. The method of claim 12, wherein rupturing, responsive to pressure from the generated gas, the first pressure-sensitive barrier covering the one or more first openings into the first longitudinal end of the first chamber of the cooling system comprises rupturing the first pressure-sensitive barrier covering the one or more first openings extending through a wall of a housing defining the second chamber.

* * * * *